US010233890B2

(12) United States Patent
Ma et al.

(10) Patent No.: US 10,233,890 B2
(45) Date of Patent: Mar. 19, 2019

(54) GASOLINE ENGINE STARTING RELAY AND METHOD OF STARTING A GASOLINE ENGINE

(71) Applicant: ZHEJIANG SUNSEEKER INDUSTRIAL CO., LTD., Jinhua, Zhejiang Province (CN)

(72) Inventors: Miaowu Ma, Jinhua (CN); Qing Zhang, Jinhua (CN)

(73) Assignee: ZHEJIANG SUNSEEKER INDUSTRIAL CO., LTD, Jinhua, Zhejiang Province (CN)

( * ) Notice: Subject to any disclaimer, the term of this patent is extended or adjusted under 35 U.S.C. 154(b) by 54 days.

(21) Appl. No.: 15/599,313

(22) Filed: May 18, 2017

(65) Prior Publication Data

US 2018/0209391 A1 Jul. 26, 2018

(30) Foreign Application Priority Data

Jan. 25, 2017 (CN) ..... 2017 1 00559688

(51) Int. Cl.

| | |
|---|---|
| ***F02N 11/12*** | (2006.01) |
| ***F02N 1/02*** | (2006.01) |
| ***F02N 3/02*** | (2006.01) |
| *F02B 63/02* | (2006.01) |
| *F02N 11/00* | (2006.01) |
| *F02N 11/14* | (2006.01) |

(52) U.S. Cl.

CPC ..... *F02N 11/12* (2013.01); *F02N 1/02* (2013.01); *F02N 3/02* (2013.01); *F02B 63/02* (2013.01); *F02N 11/00* (2013.01); *F02N 11/14* (2013.01); *F02N 2300/2002* (2013.01)

(58) Field of Classification Search

CPC ... F02N 11/12; F02N 1/02; F02N 3/02; F02N 11/00; F02N 11/14; F02N 2300/2002; F02B 63/02

See application file for complete search history.

(56) References Cited

U.S. PATENT DOCUMENTS

| | | | | |
|---|---|---|---|---|
| 3,437,083 A * | 4/1969 | Hamman | ..... | F02N 11/12 123/179.26 |
| 3,596,647 A * | 8/1971 | Heisler | ..... | F02N 11/12 123/179.26 |
| 3,885,544 A * | 5/1975 | Pfeiffer | ..... | F02N 11/12 123/179.26 |

(Continued)

*Primary Examiner* — Stephen K Cronin
*Assistant Examiner* — Xiao En Mo
(74) *Attorney, Agent, or Firm* — Andrew Berks

(57) ABSTRACT

The present invention relates to the field of power tool devices, and more specifically, to a gasoline engine starting relay and a method of starting a gasoline engine. The small two-stroke or four-stroke gasoline engine starting relay comprises a housing, a power transfer end assembly, a power output end assembly, wherein the housing is provided with a device tube slot which has holes on both sides, namely a power transfer end hole and a power output end hole respectively, and which is mated with the power transfer end assembly and the power output end assembly. It can significantly improve and resolve the starting performance of a gasoline engine, and avoid difficulty in the hand-pulled starting so that the starting effect on a gasoline engine with large emissions for female workers, who may find difficulty in hand-pulled starting, is extremely obvious.

8 Claims, 9 Drawing Sheets

(56) References Cited

U.S. PATENT DOCUMENTS

| | | | | |
|---|---|---|---|---|
| 7,150,139 | B1 * | 12/2006 | Lund | A01D 34/00 56/10.8 |
| 7,530,340 | B1 * | 5/2009 | Jellinek | F02N 11/10 123/179.1 |
| 2016/0230738 | A1 * | 8/2016 | Koehler | F02N 15/022 |
| 2017/0363056 | A1 * | 12/2017 | Budden | F02B 63/02 |
| 2018/0195484 | A1 * | 7/2018 | Koehler | |

* cited by examiner

GASOLINE ENGINE STARTING RELAY AND METHOD OF STARTING A GASOLINE ENGINE

CROSS REFERENCE TO RELATED APPLICATION

This application claims priority to Chinese patent application 2017100559688, filed Jan. 25, 2017, the entire contents of which are incorporated by reference.

BACKGROUND OF THE INVENTION

Technical Field

The present invention relates to the field of power tool devices, and more specifically, to a gasoline engine starting relay and a method of starting a gasoline engine.

Description of Related Art

Currently, the structure of the starters applied to small two-stroke or four-stroke gasoline engines in domestic and foreign markets mainly have the following types: 1. a hand-pulled starter of a single-loop coil spring structure, commonly known as a single starter; 2. a hand-pulled starter with a loop coil spring plus an accumulative torsional spring or a loop coil spring plus an accumulative coil spring, commonly known as a convenient starter; 3. a hand-pulled starter with a loop coil spring plus an accumulative coil spring plus a stopping structure, commonly known as ultra-convenience starter; the use of these three types of starters in the market is as follows: the single starter of a simple structure has a low cost, but a poor hand feeling in use, however a great impact is that it has a higher advantage when used in an engine with emissions of less than 40 cc, though it is relatively difficult to use in an engine with emissions of more than 40 cc, therefore, very few products use this type of starter currently; the convenient starter of a slightly complicated structure compared with the single starter, which has an accumulative torsional spring or an accumulative coil spring added, is the most frequently used structure of the starters in the market currently. But for an engine with emissions of more than 40 cc it is still considered to have a dry hand feeling during a cold start, and still needs a larger impact pull when used for starting a gasoline engine.

BRIEF SUMMARY OF THE INVENTION

The objective of the present invention is to provide a gasoline engine starting relay and a method of starting a gasoline engine, which can significantly improve and resolve the starting performance of a gasoline engine, and avoid difficulty in the hand-pulled starting so that the starting effect on a gasoline engine with large emissions for female workers, who may find difficulty in hand-pulled starting, is extremely obvious, and which is capable of being applied to products using a gasoline engine as a driving force such as brush cutters, grass trimmers, chain saws, leaf blowing sucking machines, pruners and lawn machines using a two-stroke or four-stroke gasoline engine.

The present invention is achieved in the following ways: a small two-stroke or four-stroke gasoline engine starting relay comprises a housing, a power transfer end assembly, a power output end assembly, wherein the housing is provided with a device tube slot which has holes on both sides, namely a power transfer end hole and a power output end hole respectively, and which is mated with the power transfer end assembly and the power output end assembly;

the power transfer end assembly comprises a roller bearing and a power transfer shaft, wherein the power transfer shaft—which is sleeved with the roller bearing—comprises a power connector, a transfer shaft seal axis and a transfer shaft linkage shaft tube; the transfer shaft seal axis is provided in the power transfer end hole, with the power connector of the head end of the transfer shaft seal axis extending out of the device tube slot and exposed to the outside of the housing, the transfer shaft linkage shaft tube is provided in the device tube slot in the power transfer end hole, and the transfer shaft seal axis is sleeved with the roller bearing;

the power output end assembly comprises a unidirectional roller bearing and a power output shaft, wherein the power transfer shaft comprises a power output head, an output shaft seal axis, an output shaft linkage shaft and an output end bearing; the output shaft seal axis is provided in the power end hole, with the power output head extending out of the head end of the output shaft seal axis and exposed to the outside of the housing from the power output end hole, and the output shaft seal axis is sleeved with the output end bearing, and the unidirectional roller bearing is sleeved on the output shaft linkage shaft;

the output shaft linkage shaft of the power output end assembly is mated in the transfer shaft linkage shaft tube, and the unidirectional roller bearing is sandwiched between the lower portion of the inner wall of the body of the transfer shaft linkage shaft tube, with the power transfer end assembly and the power output end assembly connected as a whole.

Preferably, the unidirectional roller bearing is a unidirectional rolling-needle bearing.

Preferably, the power transfer end assembly comprises an overrunning clutch and a power transfer shaft, with the power transfer shaft sleeved with the overrunning clutch.

Preferably, at least two turns of built-in stopping rings are provided in the device tube slot, with the unidirectional roller bearing, the overrunning clutch or the transfer shaft linkage shaft tube engaged in the middle of the built-in stopping rings.

Preferably, the power output end assembly is provided on the surface with a seal housing which is further provided with a cuff surrounding the power output shaft by one turn.

Preferably, the cross-section of the power output shaft or the power transfer shaft is of a triangular, quadrangular, pentagonal, hexagonal, quadrangular, pentagonal, hexagonal or pinion shape.

Preferably, the cuff of an accurate, trapezoidal or triangular shape comprises a surrounding wall shell and a cuff slot provided in the middle of the surrounding wall shell.

Preferably, the power transfer end assembly comprises an overrunning clutch and a power transfer shaft, wherein the power transfer shaft is sleeved with the overrunning clutch which can be formed by way of taking the unidirectional roller bearing and the output end bearing as a whole, and which has a uni-forward rotation or a uni-backward rotation so as to free workers from identification of the forward and backward directions of the housing during assembling; the cuff may be further provided with a base plate which is provided with threads and can be screwed into the hole of the housing, and such an arrangement also can further speed up the assembling of the product.

A gasoline engine comprising a starting relay comprises a gasoline engine body and a starting relay, wherein the starting relay is provided in the output shaft hole of an electric starter of the gasoline engine body;

The power output shaft of the power output end assembly of the starting relay is mated or engaged or welded or screwed or snap-fitted in the output shaft hole of the electric starter, with the electric starter and the starting relay connected as a whole; a protective connecting cover is further sleeved outside the starting relay and is provided with a relay through hole in the middle, and the protective cover is sleeved or integrally connected outside the output shaft hole of the electric starter.

Preferably, the electric starter comprises an electric starter housing, a starting drawstring, a starting coil spring, an inner starting wheel, a starting torsional spring, an outer starting wheel, a starting wheel pressing plate, a guide wire bushing, a starting drawstring handle device, wherein the electric starter housing is provided toward the inner side of the gasoline engine body with a starting drawstring, with the tail end of the starting drawstring connected to the starting coil string which is provided on the outer starting wheel; the outer starting wheel is provided with the starting torsional spring at the bottom and is further provided with the starting wheel pressing plate at the bottom, with the starting torsional spring sandwiched inside the outer starting wheel and the starting wheel pressing plate while the starting drawstring, the starting coil spring, the inner starting wheel, the starting torsional spring, the outer starting wheel, the starting wheel pressure is press-welded in the inner side of the electric starter housing via screws by means of the starting wheel pressing plate; the electric starter housing is provided with a guide wire bushing extending out of the outer side of the gasoline engine body through the inner side of the gasoline engine body, with the starting drawstring head end extending to the outer side of the gasoline engine body through the guide wire bushing and connected on the starting drawstring's handle device.

Comparing with the prior art, the beneficial effects of the present invention are as follows: a conventional household AC hand drill or a DC rechargeable hand drill chuck can be used to clamp the power transfer shaft of the drill's external starter; the rotation direction of the conventional AC hand drill or the DC charging hand drill is set to be right-handed; the gears of the DC rechargeable hand drill should be adjusted to the position of the drilling hole during use, and the rotating speed of the drill should be set to a high-speed state (≥1000 rpm); the output shaft of the connector of the drill's external starter is inserted in the through hole reset on the gasoline engine's starter, making the pentagonal or other polygonal, floral and toothed structures of the output shaft of the connector matched with those of the electric starter connector at the input end of the gasoline engine crankshaft; the housing of the connector of the drill's external starter is rotated to match the cuff on the housing with the slot on the starter. When the drill is started, the drill chuck drives the power transfer shaft of the connector of the drill's starter to rotate, the power transfer shaft drives the unidirectional roller bearing to rotate in the same direction, the unidirectional bearing's reverse-stop function drives the output shaft to rotate in the same direction, and the output shaft drives the electric starter connecting shaft at the input end of the gasoline engine crankshaft to rotate in the same direction, so as to drive the gasoline engine crankshaft to rotate, and meanwhile a piston starts to enter a cycle of compression and working; when the crankshaft speed ≥1000 rpm, the gasoline engine igniter begins to work, so that the gasoline engine is successfully started into an idling state. The idling range of the gasoline engine when started remains between 2500~3500 rpm; the gasoline engine crankshaft starts to drive the electric starter connecting shaft to rotate in a right-handed direction after the gasoline engine is started, and the electric starter connecting shaft drives the output shaft of the electric starter connector to rotate in a right-handed direction, with the output shaft of the electric starter connector and the power transfer shaft connected by means of the unidirectional roller bearing; when the output shaft is rotates following the gasoline engine crankshaft, the unidirectional roller bearing's function of unidirectional rotation halts the power transfer shaft so as to avoid the possible damage to users caused by the drill's rotation following the crankshaft.

A conventional household AC hand drill or a DC rechargeable hand drill chuck is used to clamp the power transfer shaft provided on the one-piece electric starter; the rotation direction of the conventional AC hand drill or the DC charging hand drill is set to be right-handed; the gears of the DC rechargeable hand drill should be adjusted to the position of the drilling hole during use, and the rotating speed of the drill should be set to a high-speed state (≥1000 rpm); when the hand drill is started, the drill chuck drives the power transfer shaft on the one-piece electric starter to rotate in a right-handed direction, the reserve-stop function of the unidirectional roller bearing press-welded on the power transfer shaft drives the output shaft to rotate in a right-handed direction, and the output shaft drives the electric starter connecting shaft at the input end of the gasoline engine crankshaft, so as to drive the gasoline engine crankshaft, and meanwhile a piston starts to enter a cycle of compression and working; when the crankshaft speed ≥1000 rpm, the gasoline engine igniter begins to work, so that the gasoline engine is successfully started into an idling state. The idling range of the gasoline engine when started remains between 2500~3500 rpm; the gasoline engine crankshaft starts to drive the electric starter connecting shaft to rotate in a right-handed direction after the gasoline engine is started, and the electric starter connecting shaft drives the output shaft of the one-piece electric starter to rotate in a right-handed direction, with the output shaft of the one-piece electric shaft and the power transfer shaft connected by means of the unidirectional roller bearing; when the output shaft is rotates following the gasoline engine crankshaft, the unidirectional roller bearing's function of unidirectional rotation halts the power transfer shaft so as to avoid the possible damage to users caused by the drill's rotation following the crankshaft.

DETAILED DESCRIPTION OF THE INVENTION

Figure 1:
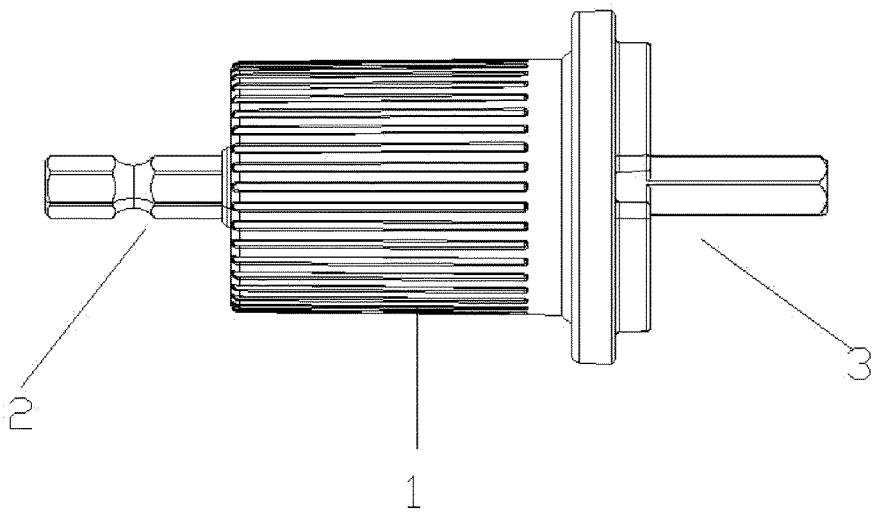
FIG. 1 is a structural diagram of the appearance of the starter.
Figure 2:
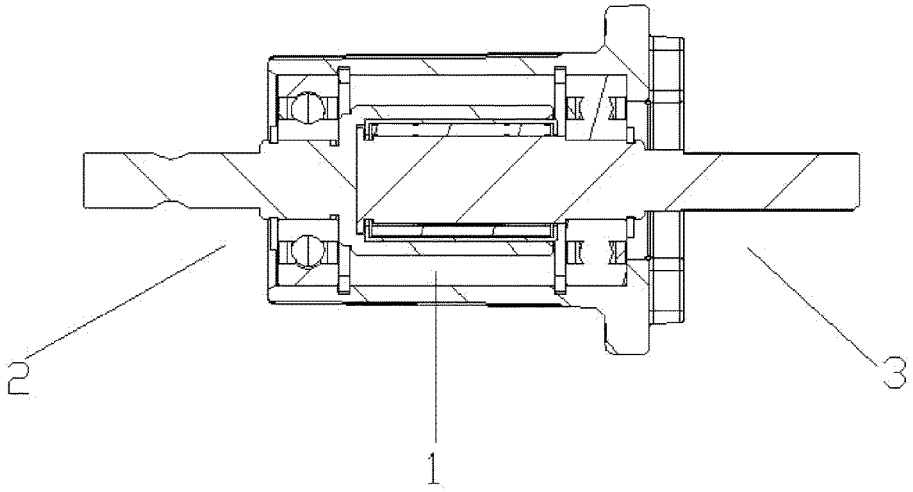
FIG. 2 is a perspective view of the starter.
Figure 3:
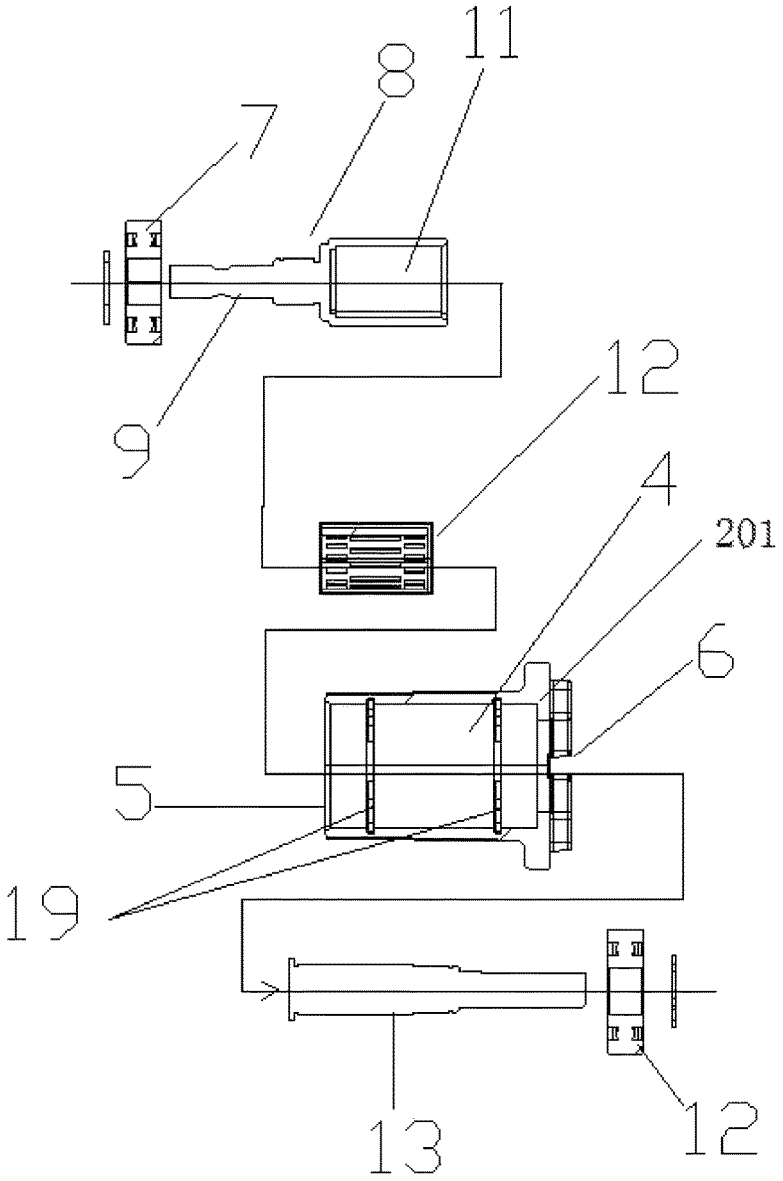
FIG. 3 is a breakdown view of the assembly of the starter.
Figure 4:
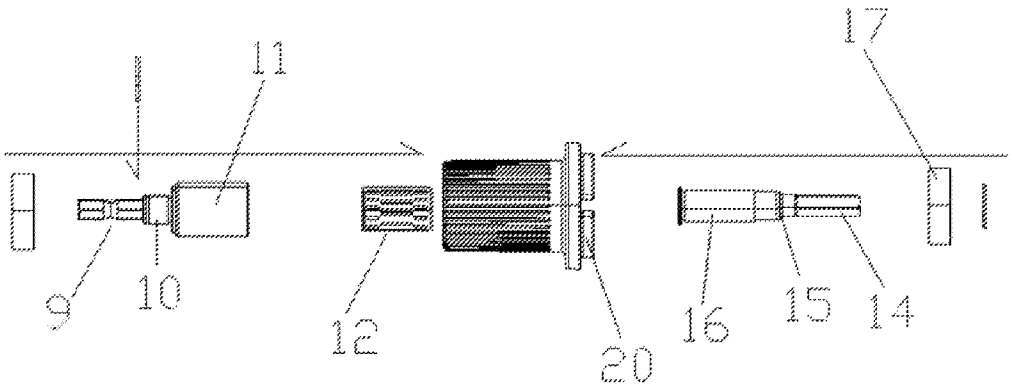
FIG. 4 is an assembly diagram of the starter.
Figure 5:
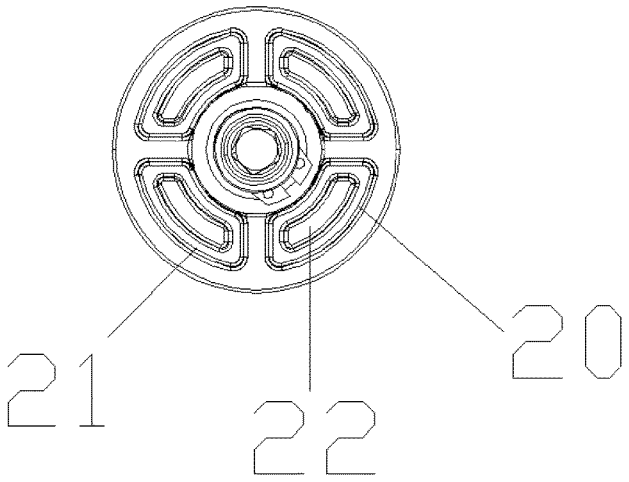
FIG. 5 is a structural diagram of the sealed housing.
Figure 6:
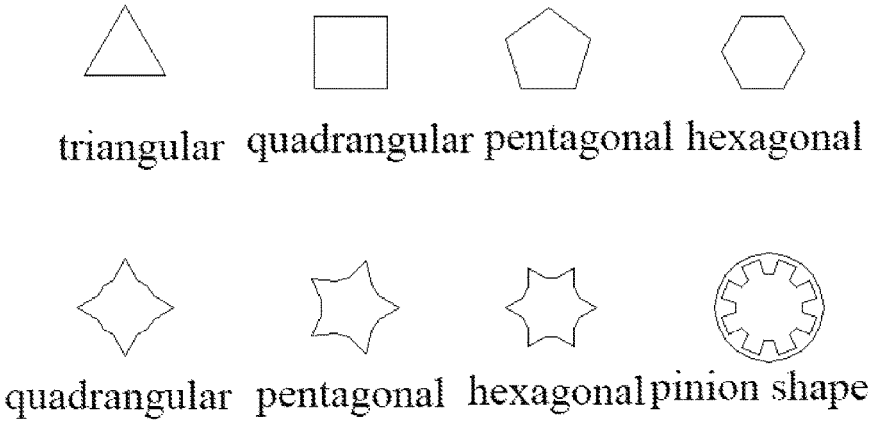
FIG. 6 is a patterned diagram of the cross section of the starter's power transfer shaft and the power output shaft.
Figure 7:
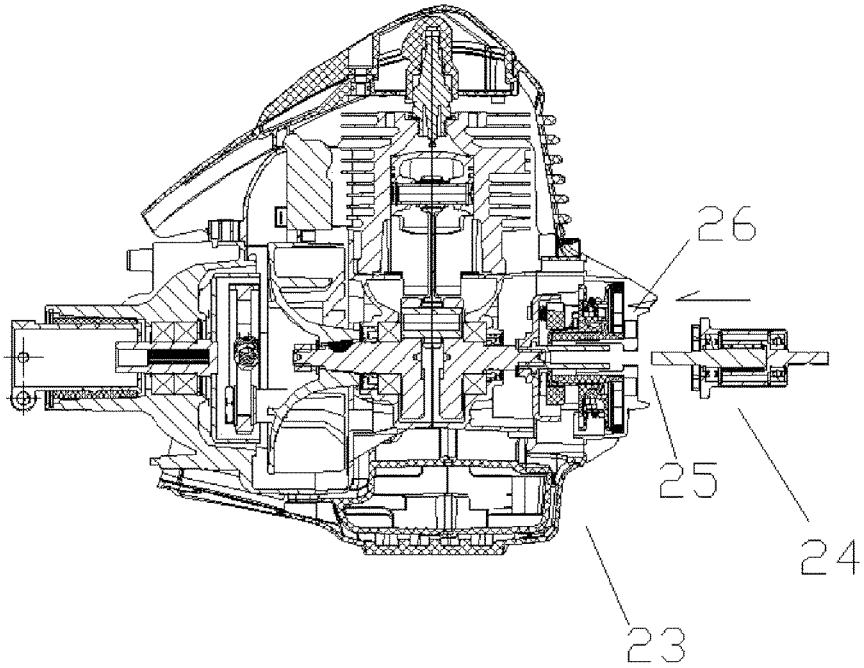
FIG. 7 is a structural diagram of the gasoline engine comprising the starting relay.
Figure 8:
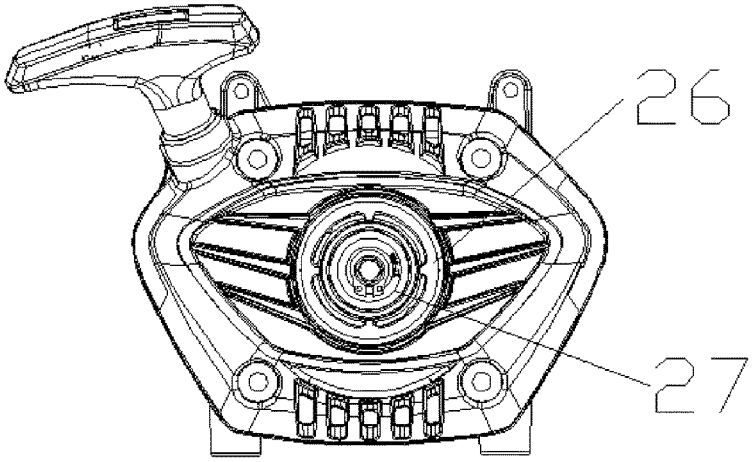
FIG. 8 is a main view of the structure of the gasoline engine electric starter in Embodiment 3.
Figure 9:
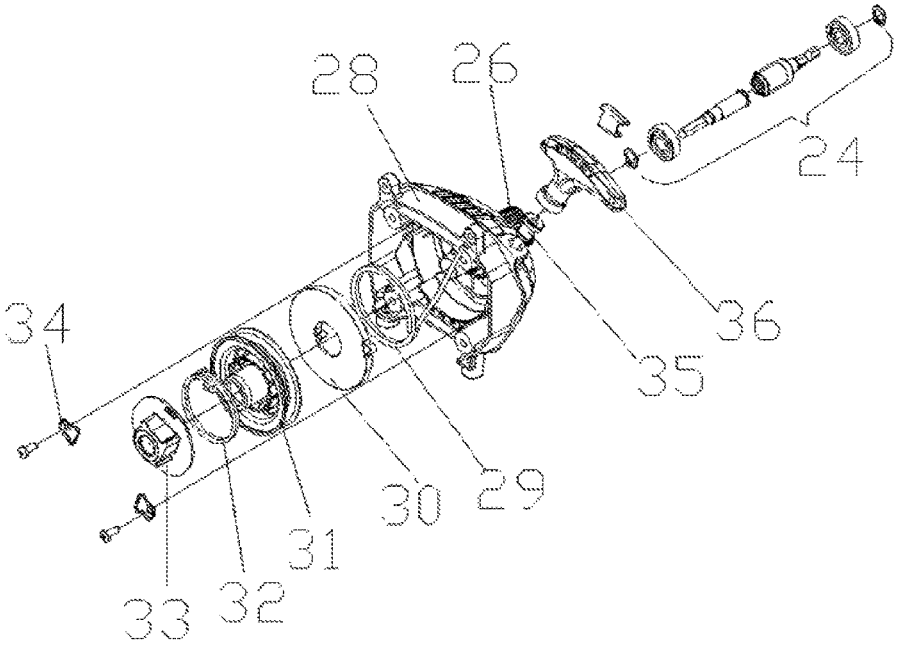
FIG. 9 is an exploded view of the structure of the gasoline engine electric starter in Embodiment 3.
Figure 10:
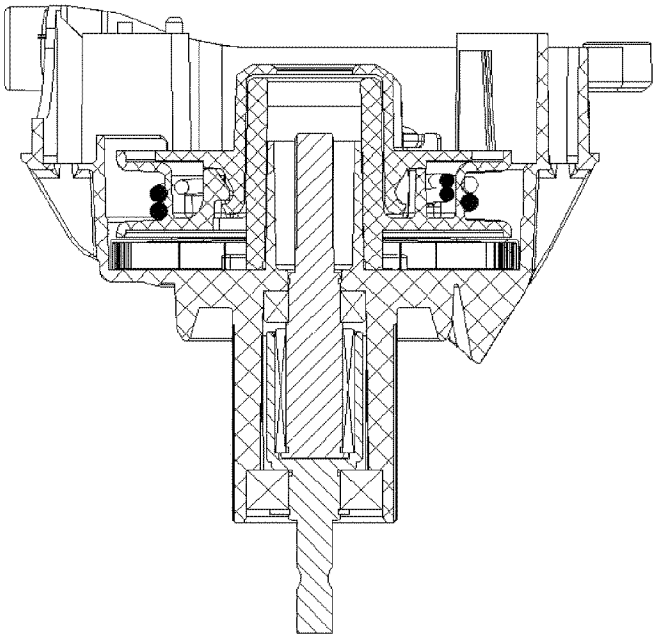
FIG. 10 is a breakdown view of the structure of the gasoline engine electric starter in Embodiment 3.
Figure 11:
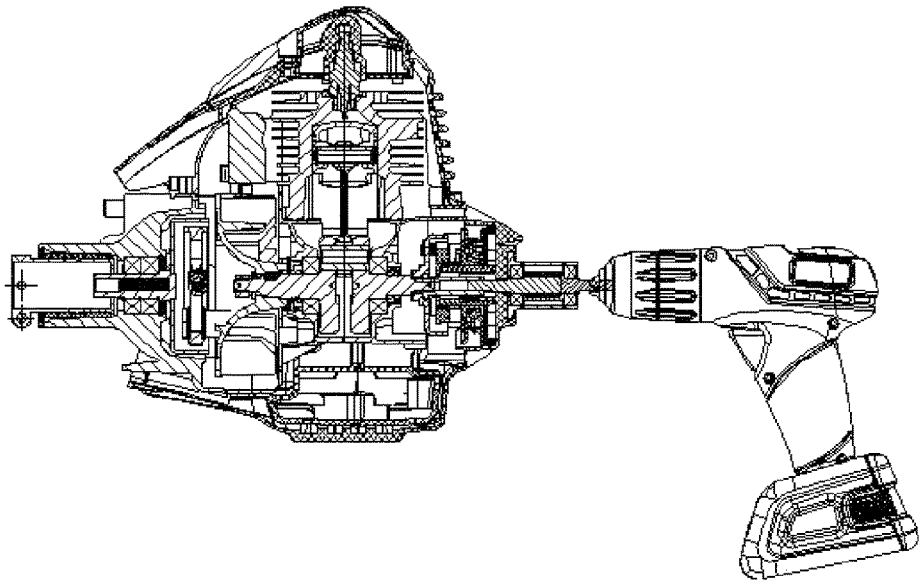
FIG. 11 is a structural diagram of the first implementation method in Embodiment 3.
Figure 12:
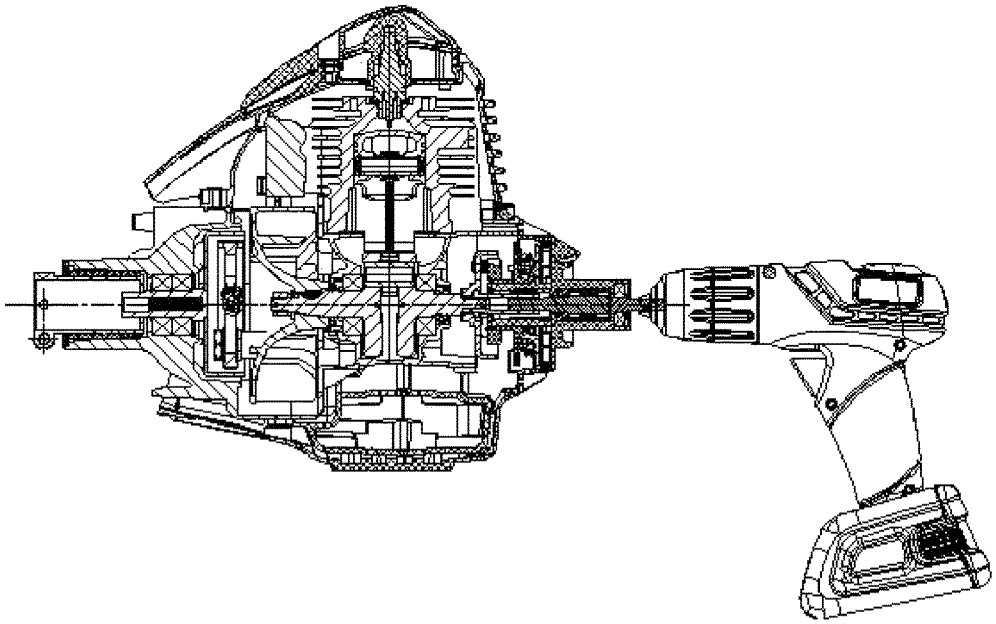
FIG. 12 is a structural diagram of the second implementation method in Embodiment 3.

The technical solution of the present invention is further detailed through the embodiments in combination with the drawings as below.

Embodiment 1 as shown in FIG. 1-5: a small two-stroke or four-stroke gasoline engine starting relay comprises a housing (1), a power transfer end assembly (2), a power output end assembly (3), wherein the housing is provided with a device tube slot (4) which has holes on both sides, namely a power transfer end hole (5) and a power output end hole (6) respectively, and which is mated with the power transfer end assembly and the power output end assembly;

the power transfer end assembly comprises a roller bearing (7) and a power transfer shaft (8), wherein the power transfer shaft which is sleeved with the roller bearing comprises a power connector (9), a transfer shaft seal axis (10) and a transfer shaft linkage shaft tube (11); the transfer shaft seal axis is provided in the power transfer end hole, with the power connector of the head end of the transfer shaft seal axis extending out of the device tube slot and exposed to the outside of the housing, the transfer shaft linkage shaft tube is provided in the device tube slot in the power transfer end hole, and the transfer shaft seal axis is sleeved with the roller bearing;

the power output end assembly comprises a unidirectional roller bearing (12) and a power output shaft (13), wherein the power transfer shaft comprises a power output head (14), an output shaft seal axis (15), an output shaft linkage shaft (16) and an output end bearing (17); the output shaft seal axis is provided in the power end hole, with the power output head extending out of the head end of the output shaft seal axis and exposed to the outside of the housing from the power output end hole, and the output shaft seal axis is sleeved with the output end bearing, and the unidirectional roller bearing is sleeved on the output shaft linkage shaft;

the output shaft linkage shaft of the power output end assembly is mated in the transfer shaft linkage shaft tube, and the unidirectional roller bearing is sandwiched between the lower portion of the inner wall of the body of the transfer shaft linkage shaft tube, with the power transfer end assembly (2) and the power output end assembly (3) connected as a whole.

Preferably, the unidirectional roller bearing is a unidirectional rolling-needle bearing.

Preferably, the power transfer end assembly comprises an overrunning clutch (18) and a power transfer shaft, with the power transfer shaft sleeved with the overrunning clutch.

Preferably, at least two turns of built-in stopping rings (19) are provided in the device tube slot, with the unidirectional roller bearing, the overrunning clutch or the transfer shaft linkage shaft tube engaged in the middle of the built-in stopping rings.

Preferably, the power output end assembly is provided on the surface with a seal housing (201) which is further provided with a cuff (20) surrounding the power output shaft by one turn.

Preferably, the cross-section of the power output shaft or the power transfer shaft is of a triangular, quadrangular, pentagonal, hexagonal, quadrangular, pentagonal, hexagonal or pinion shape.

Preferably, the cuff of an accurate, trapezoidal or triangular shape comprises a surrounding wall shell (21) and a cuff slot (22) provided in the middle of the surrounding wall shell.

Figure 13:
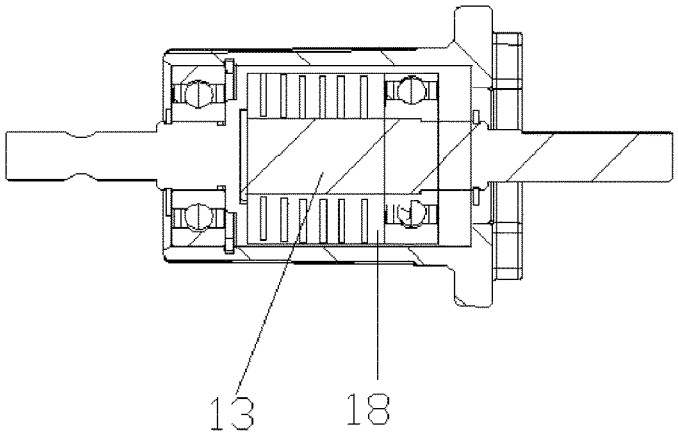
FIG. 13 is a structural diagram of Embodiment 2.

Embodiment 2 as shown in FIG. 13: preferably, the power transfer end assembly comprises an overrunning clutch (18) and a power transfer shaft, wherein the power transfer shaft is sleeved with the overrunning clutch which can be formed by way of taking the unidirectional roller bearing and the output end bearing as a whole, and which has a uni-forward rotation or a uni-backward rotation so as to free workers from identification of the forward and backward directions of the housing during assembling; the cuff may be further provided with a base plate which is provided with threads and can be screwed in the hole of the housing, and such an arrangement also can further speed up the assembling of the product.

Embodiment 3 as shown in FIG. 7-12: a gasoline engine comprising a starting relay comprises a gasoline engine body (23) and a starting relay (24), wherein the starting relay is provided in the output shaft hole (25) of an electric starter of the gasoline engine body;

The power output shaft of the power output end assembly of the starting relay is mated or engaged or welded or screwed or snap-fitted in the output shaft hole of the electric starter, with the electric starter and the starting relay connected as a whole; a protective connecting cover (26) is sleeved outside the starting relay and is provided with a relay through hole (27) in the middle, and the protective cover is sleeved or integrally connected outside the output shaft hole of the electric starter.

Preferably, the electric starter comprises an electric starter housing (28), a starting drawstring (29), a starting coil spring (30), an inner starting wheel (31), a starting torsional spring (32), an outer starting wheel (33), a starting wheel pressing plate (34), a guide wire bushing (35), a starting drawstring handle device (36), wherein the electric starter housing is provided toward the inner side of the gasoline engine body with a starting drawstring, with the tail end of the starting drawstring connected to the starting coil string which is provided on the outer starting wheel; the outer starting wheel is provided with the starting torsional spring at the bottom and is further provided with the starting wheel pressing plate at the bottom, with the starting torsional spring sandwiched inside the outer starting wheel and the starting wheel pressing plate while the starting drawstring, the starting coil spring, the inner starting wheel, the starting torsional spring, the outer starting wheel, the starting wheel pressure press-welded in the inner side of the electric starter housing via screws by means of the starting wheel pressing plate; the electric starter housing is provided with a guide wire bushing extending out of the outer side of the gasoline engine body through the inner side of the gasoline engine body, with the starting drawstring head end extending to the outer side of the gasoline engine body through the guide wire bushing and connected on the starting drawstring's handle device.

A method for starting a small gasoline engine or a small gasoline engine-based garden tool by means of a starting relay comprises the following steps: a DC rechargeable hand drill or an AC hand drill is alternatively selected to match the pattern of the cross section of the DC rechargeable hand drill or the AC hand drill chuck, and the power output shaft of the electric starter with a small two-stroke or four-stroke gasoline engine uses the power transfer shaft and the power output shaft with the same cross-sectional pattern, with the cross-section of the power output shaft or the power transfer shaft of a triangular, quadrangular, pentagonal, hexagonal, quadrangular, pentagonal, hexagonal or pinion shape; the power transfer shaft of the starting relay is inserted into the DC rechargeable hand drill or the AC hand drill chuck, and after fixation, the handle of the DC rechargeable hand drill or the AC hand drill is grasped to be aligned and connected to the electric starter, to engage the starting relay cuff in the slot of the electric starter housing fixedly and stably, so as to ensure that the power transfer shaft of the starter relay completely mates or sleeves the power output shaft of the gasoline engine electric starter; the DC rechargeable hand drill or the AC hand drill is started, and the rotating speed of the drill is set to a high-speed state (≥1000 rpm) according to the starting requirements of the gasoline engine; the chuck drives the power transfer shaft, the roller bearing of the power transfer shaft then drives the unidirectional roller bearing to rotate in the same direction, the unidirectional bearing's reverse-stop function drives the output shaft to rotate in the same direction, and the output shaft drives the electric starter connecting shaft at the input end of the gasoline engine crankshaft to rotate in the same direction, so as to drive the gasoline engine crankshaft to rotate, and meanwhile a piston starts to enter a cycle of compression and working; when the crankshaft speed ≥1000 rpm, the gasoline engine igniter begins to work, so that the gasoline engine is successfully started into an idling state. The idling range of the gasoline engine when started remains between 2500~3500 rpm; the gasoline engine crankshaft starts to drive the electric starter connecting shaft to rotate in a right-handed direction after the gasoline engine is started, and the electric starter connecting shaft drives the power output shaft of the electric starter connector to rotate in a right-handed direction, with the power output shaft of the electric starter connector and the power transfer shaft connected by means of the unidirectional roller bearing; when the power output shaft is rotates following the gasoline engine crankshaft, the unidirectional roller bearing's function of unidirectional rotation halts the power transfer shaft so as to avoid the possible damage to users caused by the drill's rotation following the crankshaft.

A method for starting a gasoline engine comprising a starting relay comprises the following steps: the pattern of the cross section of the DC rechargeable hand drill or the AC hand drill chuck is matched, and the power output shaft and the power output shaft with the same cross-sectional pattern are used; the power transfer shaft of the starting relay is inserted in the DC rechargeable hand drill or the AC hand drill chuck, and after fixation, the handle of the DC rechargeable hand drill or the AC hand drill is grasped to be aligned and connected to the electric starter; the starting relay integrated with the electric starter is inserted to insert the power transfer shaft of the starting relay into the DC rechargeable hand drill or the AC hand drill chuck, and after fixation, the DC rechargeable hand drill or the AC hand drill is started, and the rotating speed of the drill is set to a high-speed state (≥1000 rpm) according to the starting requirement of the gasoline engine; the chuck drives the power transfer shaft, the roller bearing of the power transfer shaft then drives the unidirectional roller bearing to rotate in the same direction, the unidirectional bearing's reverse-stop function drives the output shaft to rotate in the same direction, and the power output shaft drives the electric starter connecting shaft at the input end of the gasoline engine crankshaft to rotate in the same direction, so as to drive the gasoline engine crankshaft to rotate, and meanwhile a piston starts to enter a cycle of compression and working; when the crankshaft speed ≥1000 rpm, the gasoline engine igniter begins to work, so that the gasoline engine is successfully started into an idling state. The idling range of the gasoline engine when started remains between 2500~3500 rpm; the gasoline engine crankshaft starts to drive the electric starter connecting shaft to rotate in a right-handed direction after the gasoline engine is started, and the electric starter connecting shaft drives the power output shaft of the electric starter connector to rotate in a right-handed direction, with the power output shaft of the electric starter connector and the power transfer shaft connected by means of the unidirectional roller bearing; when the power output shaft is rotates following the gasoline engine crankshaft, the unidirectional roller bearing's function of unidirectional rotation halts the power transfer shaft so as to avoid the possible damage to users caused by the drill's rotation following the crankshaft.

The embodiments described herein are only intended to give examples based on the spirit of the present invention. Those skilled in this art can make various modifications or supplements or adopt alternative similarities to the described embodiments, without departing from the spirit of the present invention or exceeding the scope defined in the Claims attached.

The invention claimed is:

1. A small two-stroke or four-stroke gasoline engine starting relay comprises a housing (1), a power transfer end assembly (2), a power output end assembly (3), wherein the housing is provided with a device tube slot (4) which has holes on both sides, namely a power transfer end hole (5) and a power output end hole (6) respectively, and which is mated with the power transfer end assembly and the power output end assembly;

a. the power transfer end assembly comprises a roller bearing (7) and a power transfer shaft (8), wherein the power transfer shaft which is sleeved with the roller bearing comprises a power connector (9), a transfer shaft seal axis (10) and a transfer shaft linkage shaft tube (11); the transfer shaft seal axis is provided in the power transfer end hole, with the power connector of the head end of the transfer shaft seal axis extending out of the device tube slot and exposed to the outside of the housing, the transfer shaft linkage shaft tube is provided in the device tube slot in the power transfer end hole, and the transfer shaft seal axis is sleeved with the roller bearing;

b. the power output end assembly comprises a unidirectional roller bearing (12) and a power output shaft (13), wherein the power transfer shaft comprises a power output head (14), an output shaft seal axis (15), an output shaft linkage shaft (16) and an output end bearing (17); the output shaft seal axis is provided in the power end hole, with the power output head extending out of the head end of the output shaft seal axis and exposed to the outside of the housing from the power output end hole, and the output shaft seal axis is sleeved with the output end bearing, and the unidirectional roller bearing is sleeved on the output shaft linkage shaft;

c. the output shaft linkage shaft of the power output end assembly is mated in the transfer shaft linkage shaft tube, and the unidirectional roller bearing is sandwiched between the lower portion of the inner wall of the body of the transfer shaft linkage shaft tube, with the power transfer end assembly (2) and the power output end assembly (3) connected as a whole.

2. The small two-stroke or four-stroke gasoline engine starting relay of claim 1, wherein the unidirectional roller bearing is a unidirectional rolling-needle bearing.

3. The small two-stroke or four-stroke gasoline engine starting relay of claim 1, wherein the power transfer end assembly comprises an overrunning clutch (18) and a power transfer shaft, with the power transfer shaft sleeved with the overrunning clutch.

4. The small two-stroke or four-stroke gasoline engine starting relay of claim 1, wherein the cross-section of the power output shaft or the power transfer shaft is of a triangular, quadrangular, pentagonal, hexagonal, quadrangular, pentagonal, hexagonal or pinion shape.

5. The small two-stroke or four-stroke gasoline engine starting relay of claim 1, wherein the power output end assembly is provided on the surface with a seal housing (201) which is further provided with a cuff (20) surrounding the power output shaft by one turn.

6. The small two-stroke or four-stroke gasoline engine starting relay of claim 1, wherein at least two turns of built-in stopping rings (19) are provided in the device tube slot, with the unidirectional roller bearing, the overrunning clutch or the transfer shaft linkage shaft tube engaged in the middle of the built-in stopping rings.

7. The gasoline engine comprising a starting relay according to claim 1, characterized by: a gasoline engine body (23) and a starting relay (24), wherein the starting relay is provided in the output shaft hole (25) of an electric starter of the gasoline engine body; the power output shaft of the power output end assembly of the starting relay is mated or engaged or welded or screwed or snap-fitted in the output shaft hole of the electric starter, with the electric starter and the starting relay connected as a whole; a protective connecting cover (26) is sleeved outside the starting relay and is provided with a relay through hole (27) in the middle, and the protective cover is sleeved or integrally connected outside the output shaft hole of the electric starter.

8. The gasoline engine of claim 7 wherein the electric starter comprises an electric starter housing (28), a starting drawstring (29), a starting coil spring (30), an inner starting wheel (31), a starting torsional spring (32), an outer starting wheel (33), a starting wheel pressing plate (34), a guide wire bushing (35), a starting drawstring handle device (36), wherein the electric starter housing is provided toward the inner side of the gasoline engine body with a starting drawstring, with the tail end of the starting drawstring connected to the starting coil string which is provided on the outer starting wheel; the outer starting wheel is provided with the starting torsional spring at the bottom and is further provided with the starting wheel pressing plate at the bottom, with the starting torsional spring sandwiched inside the outer starting wheel and the starting wheel pressing plate while the starting drawstring, the starting coil spring, the inner starting wheel, the starting torsional spring, the outer starting wheel, the starting wheel pressure press-welded in the inner side of the electric starter housing via screws by means of the starting wheel pressing plate; the electric starter housing is provided with a guide wire bushing extending out of the outer side of the gasoline engine body through the inner side of the gasoline engine body, with the starting drawstring head end extending to the outer side of the gasoline engine body through the guide wire bushing and connected on the starting drawstring's handle device.

* * * * *